United States Patent [19]

Mayer

[11] Patent Number: 4,510,468

[45] Date of Patent: Apr. 9, 1985

[54] RF ABSORPTIVE LINE WITH CONTROLLED LOW PASS CUT-OFF FREQUENCY

[76] Inventor: Ferdy Mayer, 43 rue du 11 Novembre 1918, 94700 Maisons Alfort, France

[21] Appl. No.: 429,032

[22] Filed: Sep. 30, 1982

[51] Int. Cl.[3] ..... H01P 1/215; H01P 1/23

[52] U.S. Cl. ..... 333/12; 174/36; 333/206; 333/243; 333/246; 338/214

[58] Field of Search ..... 333/12, 206, 243; 174/36; 338/214

[56] References Cited

U.S. PATENT DOCUMENTS 2,877,286 3/1959 Vance et al. ..... 333/243 X

FOREIGN PATENT DOCUMENTS 1175763 8/1964 Fed. Rep. of Germany ..... 174/36

2622297 12/1977 Fed. Rep. of Germany ..... 174/36

*Primary Examiner*—Paul Gensler

*Attorney, Agent, or Firm*—Oblon, Fisher, Spivak, McClelland & Maier

[57] ABSTRACT

A transmission line for the transmission of electrical energy and signals, including at least one electrical conductor exhibiting high frequency skin effect; a low conductivity magnetic composite layer surrounding the at least one conductor and exhibiting an inductance characteristic; a resistive layer coupled to the magnetic composite layer and having a predetermined capacitance relative to ground potential, the resistive layer exhibiting a longitudinal resistance characteristic matched at least to the inductance characteristic of the magnetic composite layer to obtain a correspondingly determined low pass frequency characteristic wherein within a predetermined transition frequency range, current flow switches from the at least one conductor to the resistive layer.

41 Claims, 18 Drawing Figures

RF ABSORPTIVE LINE WITH CONTROLLED LOW PASS CUT-OFF FREQUENCY

BACKGROUND OF THE INVENTION

1. Field of the Invention

The present invention relates to lines for the transmission of electrical energy and signals, and more particularly to selective absorption conductors of the kind which selectively provide an impedance and an absorption determined within a chosen range of high frequencies. The present invention further relates to transmission cables, with several conductors, devices to transmit a certain range of frequencies, such as cables designated to attenuate certain frequencies, specially so called low pass lines, and certain types of filters.

2. Description of the Prior Art

Low pass cables have been described in both the trade literature and in various patents, including my own. Generally, their purpose is to conduct without attenuation lower frequencies such as 60 Hz line voltages, from an outlet source to a receiving appliance. However, the presence of RFI or other high frequency noise signals on such cables is to be prevented, because of compatability problems between a noise source and a noise succeptable receiver. Common examples of compatability problems are the disruptive effect that the turning on of household appliances such as an electric razor may have on a television, or a welding robot on microprocessor controls for operating the robot, and so forth.

In order to promote compatability between noise sources and succeptable receivers, lumped component filters are often used.

On the other hand, selective absorbent conductors and lines employing a distributed filtering effect are known, and described in my U.S. Pat. Nos. 3,191,132 and 3,309,633, in which dissipation is obtained by employing magnetic and dielectric lossy composite material as insulation. More especially, my U.S. patent application Ser. No. 855,593, now abandoned, continued as Ser. No. 202,654, filed Oct. 1, 1980, describes a more recent invention with the use of an improved lossy material of that kind. Such lossy cables, are specified, for military and space applications, by Standard MIL-C-85485 of Sept. 16, 1981.

Selective absorbent conductors and lines of another kind, are known and described in my U.S. Pat. No. 3,573,676, in which selective absorption is obtained by employing an "artificial" or "enhanced" skin effect.

Both dissipation technologies are based upon higher frequency physical effects, like magnetic losses in magnetic materials, and skin effects and do not permit reaching appreciably lower frequency (under 10 MHz or even 1 MHz, for example) range, where the mentioned physical phenomena cannot be used (magnetic absorption) or are difficult to implement for practical structures (artificial skin effect).

Thus, the cables noted above do show sufficient absorption in the higher frequency ranges, such as above 30 Mhz where the effects of magnetic absorption exist. This is related to the magnetic loss angle, or $\mu''$, the reactive part of magnetic permeability. However, there is a present need for a cable or transmission line exhibiting increased attenuation at lower range R.F. frequencies, that is in the 10 Mhz, or even 1 Mhz, range, which cannot be achieved by means of above mentioned effects.

SUMMARY OF THE INVENTION

Accordingly, a primary object of the present invention is to provide a novel transmission line exhibiting improved absorptive performance at relatively lower frequencies, i.e., in the 10 MHz range or even as low as 1 MHz, where the above-noted physical phenomena cannot be used (magnetic absorption) or are difficult to implement from a practical standpoint (artificial skin effect).

It is a further object of the present invention to control the cut-off frequency, i.e., the transition band between non-absorptive and absorptive frequency bands, which control is not achievable with characteristics related to basic physical phenomena.

It is a further object of the present invention to realize a "switchover" effect, where high frequency currents are switching from one conductor or line structure to another one, in a relatively small transition band, i.e., the slope of impedance or absorption versus frequency is enhanced.

It is a further object of the present invention to improve the overall absorptive performance, i.e., for a given length of conductor or cable, or a given volume of a structure containing such conductor or cable, to increase the attenuation of low frequency noise components (>1 MHz) over that of the above-mentioned technology, more especially by combining the structure according to the invention with such technologies.

It is a further object of the present invention to decrease radiation from the complementary standpoint of preventing outside detection of the transmitted signals, in its implementation in an essentially closed structure, like shielded cables, in combination with the improvements described in my U.S. Pat. No. 4,383,225, more especially for EMP and TEMPEST hardened wire and cable applications.

Additionally, with regard to the electromagnetic parasitic fields, in such hardened wires and cables, the response to ionizing radiation is an important consideration. The scattering of electronic charge in the dielectric layer and across dielectric/electrode gaps produce a parasitic signal which either can mask the desired signal or be of sufficient amplitude to cause physical damage to electronic components at the terminations (Photo-Compton Currents).

It is a further object of the present invention to reduce such signals as produced while concurrently controlling and enhancing low pass performance, i.e., increasing low frequency impedance and attenuation.

These and other objects are achieved according to the invention, by providing a new and improved transmission line for the transmission of electrical signals, including at least one conductive element (with normal or enhanced skin effect), an essentially non-conductive magnetic composite layer selected in such manner as to impose on the conductor element(s) an increased distributed inductive impedance, and a second resistive layer thereto coupled by galvanic and/or capacitive means, where the resistive impedance of the layers is designed in accordance with a chosen cut-off frequency (or transition frequency band), taking in account the values of the distributed inductive impedance and distributed capacity of the conductive element(s) to ground.

According to the invention, at lower frequencies, i.e., frequencies under the cut-off frequency, current is essentially located in the conductor(s) (with its normal or enhanced skin effect). At the cut-off frequency, the current switches to the outer resistive layer, in a reduced, predetermined frequency interval (transition range). At higher frequencies, essentially all current is located in the resistive layer. The impedance of the conductor or the attenuation of the line is then essentially that of a conductor represented by the resistance of the resistive layer or a line represented by the conductor and the ground reference (R-C line).

As will be seen from different examples to be described hereinafter, the application of the current-switching phenomenon makes it possible to obtain unexpected increased impedance or attenuation of low frequencies (>1 MHz), with the possibility of additional high frequency impedance or attenuation, more especially when the magnetic layer shows additional high frequency losses. These performances enable a practical implementation, with very simple structure of low pass cables, in the lower RF frequency range, where current absorptive and/or artificial skin effect techniques were inefficient.

BRIEF DESCRIPTION OF THE DRAWINGS

In order that the invention may be more clearly understood, some basic theoretical elements will now be described, as related to its implementation, and more especially the control of cut-off frequency, and improved lower frequency absorptive performance in the lower frequency range over above-mentioned low-pass structures, by reference to the accompanying drawings, in which.

Figure 7:
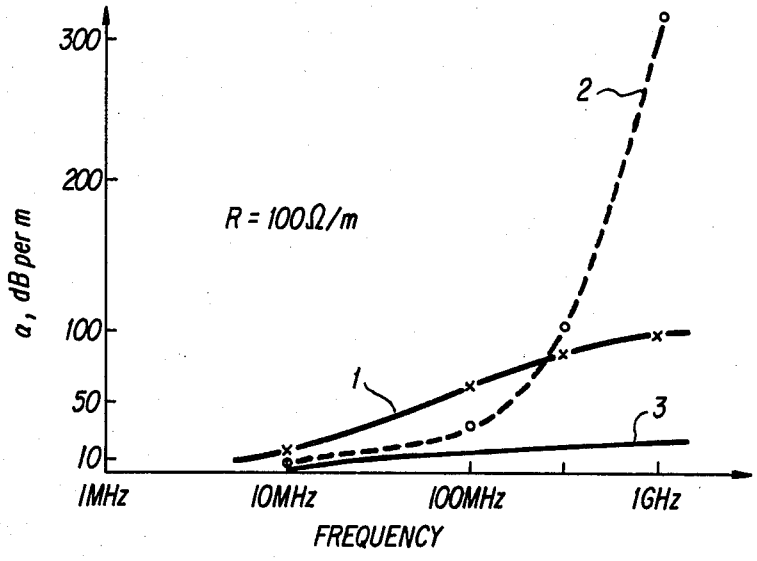
Figure 8:
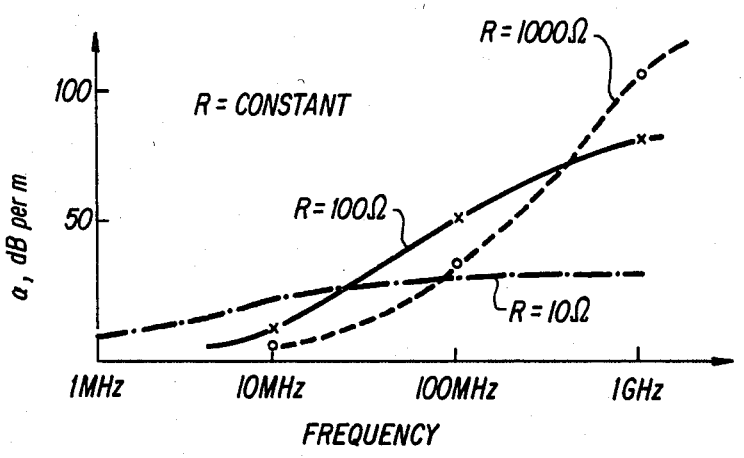

FIGS. *6a–6g* are schematic cross-sectional views of several low pass conductors and lines according to the invention;

FIG. 7 is a graph illustrating an attenuation characteristic of a typical implementation of a round coaxial cable, according to FIG. *6a*, as a function of frequency, also showing for comparison, the attenuation achieved with a magnetic non-absorptive composite alone and an absorptive magnetic composite alone;

FIG. 8 is a graph of the FIG. 7 attenuation characteristic, illustrated as a function of frequency, where the resistance of the resistive layer is varied, showing the frequency control performance.

Figure 9:
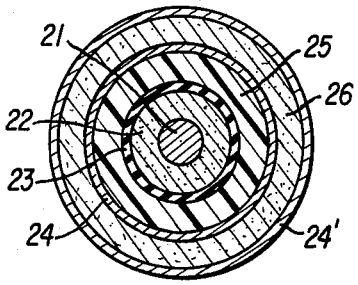
Figure 10:
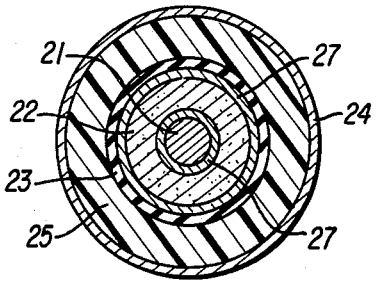
Figure 11:
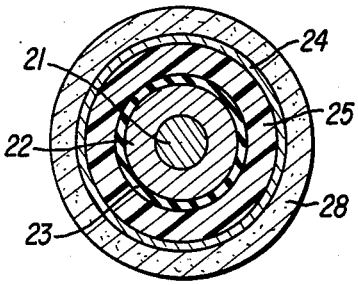

FIG. 9 is a schematic cross-sectional view of an implementation with a highly efficient screen, i.e., a low transfer impedance screen, according to the above-mentioned U.S. Pat. No. 4,383,225;

FIG. 10 is a schematic cross-sectional view of a cable with a special magnetic composite layer, and a special insulation sheath, for X-ray and $\gamma$-ray radiation protection;

FIG. 11 is a schematic cross-sectional view of a cable, according to FIGS. 6 to 10, with an additional magnetic outer layer, for common-mode suppression, TEMPEST protection and additional radiation protection, through a screen effect.

Figure 12:
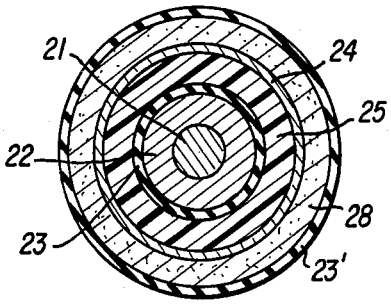

FIG. 12 is a schematic cross-sectional view of a classical co-axial cable, with common mode protection, according to the FIG. 11 view, with an outside resistive layer according to the invention.

DESCRIPTION OF THE PREFERRED EMBODIMENTS

Figure 1:
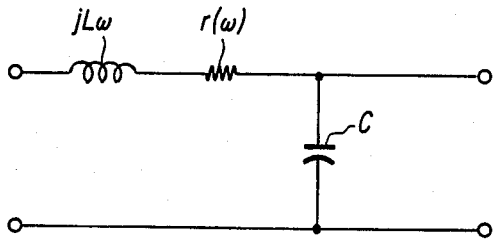
FIG. 1 is an equivalent electric circuit diagram of a classical transmission line using the normal or the artificial skin effect conductor.

Referring now to the drawings, wherein like reference numerals designate identical or corresponding parts throughout the several views, FIG. 1 illustrates the basic electric equivalent circuit diagram of a classical transmission line, according to the Kirchhoff distributed-element concept. In this diagram, $jL\omega$ represent the distributed inductance of the line; $r(\omega)$ the resistive loss term, which is frequency dependent ($f=2\pi\omega$), because of the skin effect of the conductors (and can include the artificial skin effect, according to my U.S. Pat. No. 3,573,676), C represents the distributed capacitance to ground, where electric losses are neglected.

Figure 2:
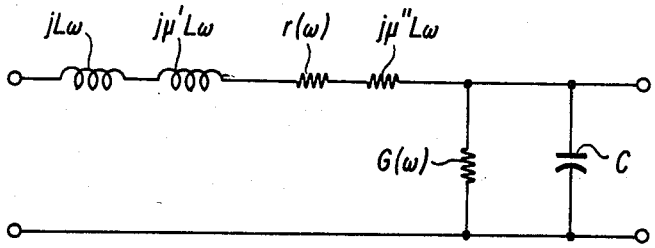
FIG. 2 is an equivalent electric circuit diagram of an electric absorptive transmission line.

FIG. 2 represents the equivalent electric circuit diagram of an electric absorptive line, according to my U.S. Pat. Nos. 3,191,132 and 3,309,633 and application Ser. No. 855,593, continued as Ser. No. 202,654. In this diagram, the additional inductive term $j\mu'L\omega$ is due to the presence around the conductor of a magnetic composite, which real part of permeability $\mu'$ enhances the internal inductance of the conductor. [Complex magnetic permeability $\mu^*=\mu'-j\mu''$, where $(\mu''/\mu')$ represents the magnetic loss angle.] An additional inductive term $j\mu''L\omega$ appears, due to the magnetic losses. Finally dielectric losses of the absorptive composite, introduce a shunt loss term $G(\omega)$, directly related to the electric loss tangent of the composite, and its frequency variance.

Figure 3:
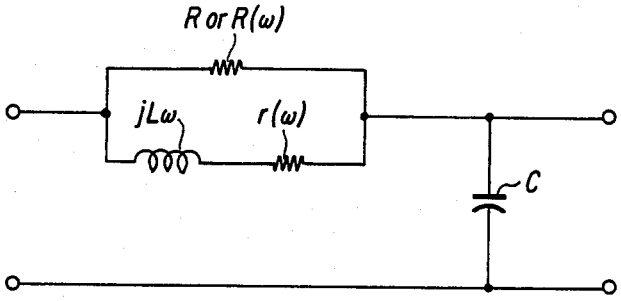
FIG. 3 is an equivalent electric circuit diagram of a transmission line in the form of a cable, corresponding to the invention, with a purely inductive second layer (neglecting loss of the magnetic composite), and a purely resistive outer layer.

FIG. 3 represents the diagram of the simplest version, starting from circuit FIG. 1, of the conductor or line according to the invention: a resistor R is connected in parallel to the addition of the different line inductive (and lossy) distributed elements L in such a way, that with increasing inductive impedance (i.e., when frequency increases), a larger and larger part of the current switches over to the resistor R.

Neglecting the conductive loss term $r(\omega)$ of the conductor and any inductance related to the physical implementation of R (external inductance, with the ground electrode), the attenuation $\alpha$ (db per meter) of such a line can easily be calculated as:

$$\alpha_{db/m} = 8.686\sqrt{LC}\sqrt{\frac{\left(\frac{L^2\omega^2}{R^2}+1\right)^{\frac{1}{2}}-1}{2\left(1+\frac{L^2\omega^2}{R^2}\right)}} \quad (1)$$

This equation is conveniently presented graphically, as attenuation per m, per Hertz of frequency, i.e. $\alpha/f$.

Figure 4:
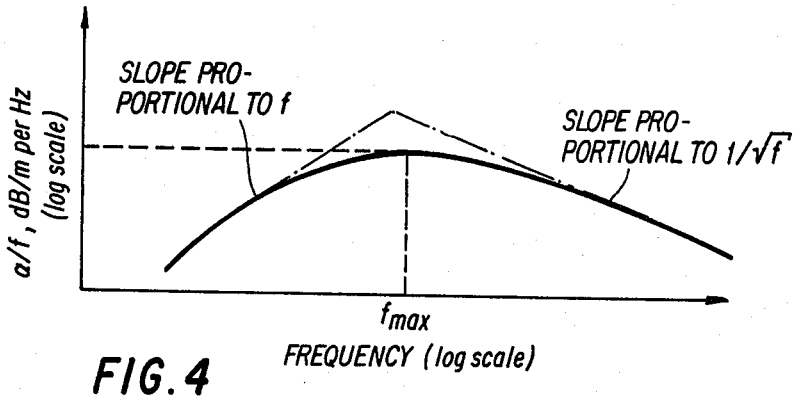
FIG. 4 is a graph illustrating the theoretical attenuation curve versus frequency of the FIG. 3 implementation.

FIG. 4 shows the representation of $\alpha/f$, in which a maximum of attenuation $\alpha_{max}/f$ equals 19.3 $\sqrt{LC}$, and is only related to the reactive components of the line. This maximum is located at a frequency $f_{max}$ equal to 0.28(R/L), and which is controlled by resistor R. In the lower frequency range, $\alpha/f$ increases proportionally with frequency; i.e. attentuation increases with $f^2$; after the maximum, $\alpha/f$ decreases proportionally to $\sqrt{f}$. Taking in account the external inductance mentioned, for some higher frequency, $\alpha$ approaches a constant asymptotic value $$\alpha_{asymp.} = 8.686 \cdot \tfrac{1}{2} \cdot \frac{R}{R\left(\sqrt{L/C}\right)} \qquad (2)$$

where $R(\sqrt{L/C}) = R(Z_c)$ represents the real part of the characteristics impedance $Z_c$). So finally, $\alpha_{asymp.}$ for a given line, is determined by R, and in that case at higher frequencies, the total current essentially flows inside resistor R. Practically, Equations 1 and 2 are approximations of reality because the mathematical model is simplified.

Inspection of equation (2) shows that the switching of the current from the conductor to the resistive layer for a given frequency needs a resistor having a value which is higher, the higher is the inductive impedance (for a given R); in other words, so as to increase lower frequency attenuation, in the aim of the invention, the inductive reactance L, has to be increased.

Figure 5:
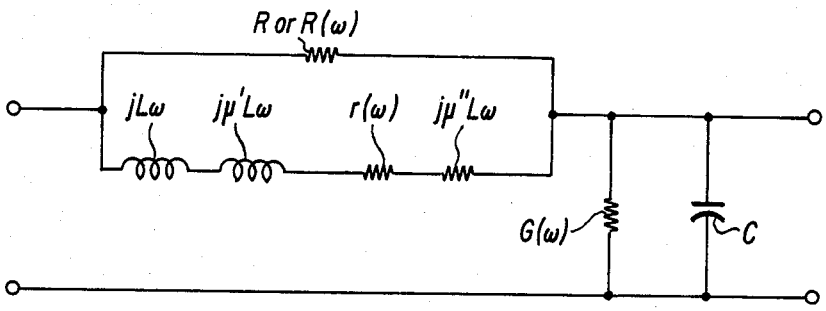
FIG. 5 is an equivalent electric circuit diagram of a FIG. 3 implementation with an absorptive magnetic composite.

For that purpose, according to the invention, the conductor will be covered by a magnetic composite, preferable with high losses (so as to use the additional advantages of the absorptive line concept). In such a case, the equivalent diagram of FIG. 5 applies. Inductance L of the equation, is to be considered the sum of the different inductances of FIG. 5, where the inductance increase is due to the magnetic composite.

Now the implementation of such an absorptive line, here referred to as a "simulated skin-effect line," becomes evident.

Figure 6A:
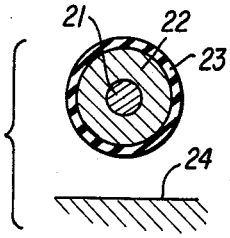

FIGS. 6*a*–6*g* show several embodiments. FIG. 6*a* illustrates a cable having a circular cross section wire, where 21 represents the plain or stranded main conductor; 22 represents the insulating magnetic composite, preferable, using one of the lossy composites described in my above-noted earlier patents; 23 represents the resistive layer, which can be implemented by any conductive composite (like carbon loaded or metallic particles loaded composite), by a wound thin metallic tape, by a resistive alloy braid, using for example metallized fibers, according to my U.S. Pat. No. 4,301,428, with eventually magnetic permeability if additional skin effect is desired, i.e., a resistor which is frequency dependent $R(\omega)$, with an increasing attenuation, with increasing higher frequencies; and 24 represents the groundplane, more or less distant from the wire, defining capacitance C, to which attenuation $\alpha$ is square root proportional (the definition of an attenuation $\alpha$, needs a four-pole structure with capacitance C to ground as shown in FIG. 1).

FIG. 6*a* shows a typical "open line" structure. Such a wire, placed close to ground, or other ground referenced conductors (like a conductor bundle) is a typical "hook up" wire implementation of the invention.

Figure 6B:
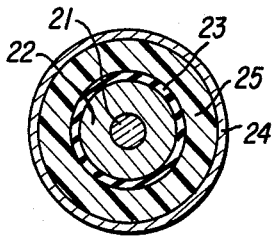
Figure 6C:
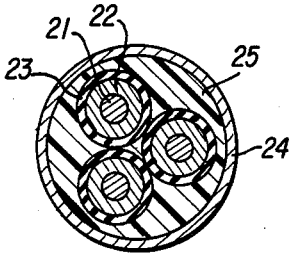
Figure 6D:
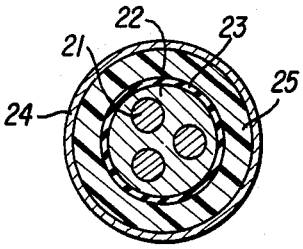

FIG. 6*b* shows the simplest coaxial structure implementation, where 24 represents this time the ground shield (braid or tape) of a coaxial cable, and 25 a non-magnetic insulating medium, conferring dielectric insulation to the cable. FIGS. 6*c* and 6*d* represent three conductor implementations.

In the typical implementation of a line described by FIG. 6*b*, the inner conductor 21 is made of plain copper, of a diameter of 1 mm. This conductor is covered with an extruded layer 22 of 1 mm thickness of magnetic composite MUSORB, which detailed specifications are described in specification No. 1, published by LEAD MAISONS-ALFORT, Paris, France. This magnetic layer is covered by a braid 23, made with nickel or silver metallized glass or nylon fibers, produced by Sauquoit, 302 Fig Street, P.O. Box 2001, Scranton, PA 18501, which are layed out as a woven braid, representing a longitudinal DC-resistance of about 100 $\omega$/m.

A next layer 25 is made of a 0.1 mm thick metallized MYLAR double wound tape, covered finally by a normal copper braid (representing the ground electrode). A final protective cover, of 0.5 mm thick PVC is applied.

The resistor sheath may be connected to the center conductor at the ends of an installed cable length, or by galvanic contact spots at intervals all along the cable, made during manufacturing.

In FIG. 6*c*, each conductor 21 is provided with composite 22 and resistive layer 23 to exhibit the simulated skin effect; whereas in FIG. 6*d*, the three conductors have a common simulated skin effect layer. In the FIG. 6*c* implementation the effect applies to differential mode transmission, as well as to common mode transmission; whereas in the FIG. 6*d* implementation, the simulated skin effect is only applied to the common mode.

Figure 6E:
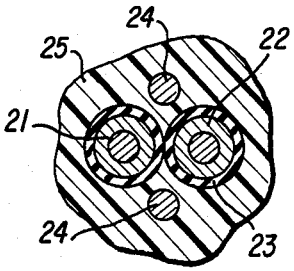
Figure 6F:
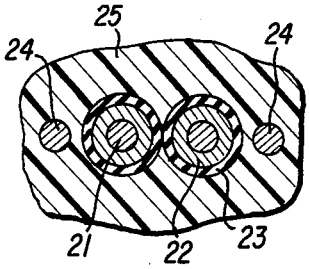

FIGS. 6*e* and 6*f* show semi-open structures. FIG. 6*f* is typical for a multiconductor flat-line implementation. In FIGS. 6*e* and 6*f*, the layer 25, discussed above in connection with the FIG. 6*b* cable, can be a semi-conductive or conductive composite, if between the layer 25 and the layer 23 an insulating layer is interposed.

Figure 6G:
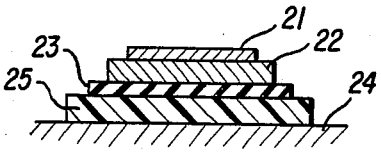

FIG. 6*g* shows a typical strip-line implementation.

The cable shown in FIG. 6*b* exhibits the attenuation characteristic of FIG. 7, curve 1. For comparison, curve 2 shows the attenuation characteristic for the same cable, without the resistive layer, i.e. a normal low pass cable, based upon magnetic absorption due to $\mu''$, as described above. For comparison purposes, curve 3 shows the attenuation characteristic for a magnetic composite with little or no absorption, i.e. essentially characterized by $\mu'$. Compared to curve 2, curve 1 shows an about ten-fold increase of attenuation at 10 MHz; with about a double attenuation at 100 MHz. Above about 200 MHz the attenuation of the simulated skin effect cable is lower than that of the absorptive cable. Indeed the absorption for even higher frequencies approaches a limit of about 80 db/m (when R is constant, because of the absence of skin effect in metallized fibers and when the external inductance is kept small (compared to L) by the use of the mentioned very thin insulating layer), whereas the attenuation due to absorption alone increases up to 10 GHz. For that reason, a practical upper limit for the transition frequency, $f_{max}$, is about 200 MHz.

For this cable, it can be shown, when the optimizing frequency $f_{max}$ is 10 MHz, the resistor layer R has to represent 100 $\omega$/m; for different values, as expected, the attenuation profile changes. For example, FIG. 8 shows for the same geometrical implementation, how $f_{max}$ changes with different values of R, allowing to increase attenuation toward lower frequencies, but decreasing at the same time asymptotic values at high frequencies. For R=constant, i.e., in the absence of skin effect in the resistive layer, the asymptotic value of attenuation is given by the equation (2) mentioned above, attenuation which is directly proportional to R, when the switching effect has occurred. Comparison of curve 2 of FIG. 7 and FIG. 8 for R=1000 ω confirms that with the lossy magnetic composite, there is no advantage of using a resistor R of over a few thousand ohms because the switching effect is then minimal. This is not the case, evidently with the nonlossy magnetic composite curve 3 of FIG. 7.

In the described cable, the basic distributed inductance of the conductor of about 0.10 μH/m, has been increased to approximately 2.5 by μH/m, by the magnetic composite, and has values which are frequency variable, because of the basic properties of the composite. In all the different implementations, the increase in inductance L can also be achieved alone or in combination with an artificial skin effect layer around the conductor, as described in my U.S. Pat. No. 3,573,676.

FIG. 9 shows a typical implementation of a superscreened low-pass line, according to the invention. This line includes the elements of the FIG. 6b cable plus a special outer metallic screen. The outer screen is made with a double braid 24, 24' (of optimized coverage and braid angle) with an additional absorptive magnetic composite 26 placed in between, according to my U.S. Pat. No. 4,383,225.

Beta and Gamma radiation induced parasitic voltages are reduced at the conductor-magnetic composite interface, because of the magnetic composite metallic oxide content of the composite 22, 26, a distinctive feature of my invention. They can be further reduced, by the use of a conductive magnetic composite material, which nevertheless must not degrade the field penetration of the magnetic composite layer 22, 26 with its skin effect.

FIG. 10 shows a typical implementation of a radiation hardened low-pass line, according to the invention where 22 represents a layer of a composite magnetic material, which has been made conductive on the inner and outer surfaces thereof (in a 0.05 to 0.5 mm depth) by an addition of magnetite (ferric ferrite) and/or black carbon to the magnetic composite, as described in my earlier U.S. Pat. No. 4,104,600. In a preferred implementation, layers 27 provided on these inner and outer surfaces are formed 0.5 mm thick. Layers 27 are extruded from a composite made of very fine grain conductive Manganese-Zinc ferrite particles, combined with magnetite powder, conferring resistivity values on the order of 1 ωom to the interface, such a composite improving conductor to dielectric contact, (avoiding tiny air spaces) and reducing the effective time constant for the suppression of X-ray or gamma-ray induced parasitic currents. The materials forming the layers 27 can be added throughout the entire thickness of layer 22 and need not be spacially limited to the inner and outer surface layers 27. Stated differently, the entire interface is filled with layer 27 material, i.e. layer 22 disappears.

A similar implementation within thin layers of fine carbon particles loaded dielectric, in the insulating interface 25, is well known in the art.

FIG. 11 shows a typical implementation, with an additional outside layer 28, of the absorptive magnetic composite. Such a structure protects against common mode currents, due to outside parasitic fields, and in addition to the FIG. 10 implementation, realizes a high density shield, reducing incoming radiations, and in consequece the radiation induced scattering effect.

The low frequency common mode suppression of the FIG. 11 line can be improved by adding another external resistive layer 23' around layer 28 as shown in FIG. 12.

Absorptive layer 28 and resistive layer 23' can be implemented within the cable manufacturing process, or as a tape, for typical retrofit use of existing and installed cables.

Recapitulating, the present invention is directed to a transmission line provided, inter alia, with a resistive layer designed to assume current conduction above a predetermined frequency, such that at frequencies below the cutoff frequency current is essentially located in a conductor surrounded by the resistive layer, while at frequencies above the cutoff frequency current conduction switches to the outer resistive layer within a predetermined frequency transition interval. The net effect is a transmission line having increased attenuation of frequencies as low as 1 Mhz. Advantageously, the transmission line of the invention can be implemented with cables of varying lengths, with resistive layers exhibiting differing resistive (R) characteristics, including the case of R being infinite (i.e. only lossy low pass cable lengths), with the resistive layer surrounding the magnetic composite layer at only predetermined discrete locations, such as at a termination end of the conductor, and/or with the resistive layer capactively coupled to the conductor at predetermined discrete locations, such as at a termination end of the conductor, whereby it is possible to obtain an ideal attenuation vs. frequency shaping to meet the demands of a particular requirement, and yet with quite considerable high frequency attenuation. Further, the principle of the invention is applicable to lines provided with plural of inductance increasing and resistive layers, thereby achieving by the principle of superposition increasing R by means of several "simulated skin effect" layers. Stil further, the transmission line of the invention can be implemented of extruded, flexible wires and lines, injected or molded nonflexible pieces of line to serve as filters and/or RF components.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cable for the transmission of electrical energy and signals, comprising:

at least one electrical conductor exhibiting high frequency skin effect;

a low conductivity magnetic composite layer surrounding said at least one conductor and in combination therewith exhibiting an inductance characteristic greater than that of the conductor alone;

a resistive layer coupled to said magnetic composite layer and exhibiting a longitudinal resistance characteristic (R) matched at least to the inductance characteristic (L) of said magnetic composite layer combined with the conductor to obtain a correspondingly determined low pass frequency characteristic α (attenuation per meter of cable), wherein α/f (f=frequency) has a maximum value at a frequency $f_{max}$, where $f_{max} \cong 0.28\ (R/L)$ such that within a predetermined transition frequency range, current flow switches from said at least one conductor to said resistive layer; and an artificial skin effect layer adjacent said magnetic composite layer for increasing the inductance of said magnetic composite layer and conductor combination.

2. A cable according to claim 1, comprising:

said magnetic composite layer being lossy; and $f_{max} < 200$ MHz.

3. A cable according to claim 1, further comprising:

said magnetic composite layer capacitively coupled to said at least one conductor.

4. A cable according to claim 1, further comprising:

said magnetic composite layer galvanically coupled to said at least one conductor.

5. A cable according to claims 1 or 2, comprising:

said resistive layer surrounding said magnetic composite layer at predetermined discrete locations.

6. A cable according to claim 5, wherein said resistive layer is provided at a termination end of the conductor.

7. A cable according to claims 1 or 2, comprising:

said resistive layer capacitively coupled to said at least one conductor at predetermined discrete locations.

8. A cable according to claim 7, wherein said resistive layer is capacitively coupled to said at least one conductor at a termination end of said transmission line.

9. A cable according to claim 7, wherein said resistive layer is capacitively coupled to said at least one conductor at predetermined intervals along said transmission line.

10. A cable according to claims 1 or 2, comprising:

said resistive layer having a frequency dependent resistance characteristic exhibiting increasing skin effect with increasing frequency.

11. A transmission line according to claims 1 or 2, comprising:

said resistive layer being only anisotropic.

12. A transmission line for the transmission of electrical energy and signals, comprising:

at least one electrical conductor exhibiting high frequency skin effect;

a first low conductivity magnetic composite layer adjacent said at least one conductor and in combination therewith exhibiting an inductance characteristic greater than that of the conductor alone;

a resistive layer coupled to said magnetic composite layer and having a predetermined capacitance relative to ground potential, said resistive layer exhibiting a longitudinal resistance characteristic (R) matched at least to the inductance characteristic (L) of said magnetic composite layer combined with the conductor to obtain a correspondingly determined low pass frequency characteristic $\alpha$(attenuation per meter of transmission line), wherein $\alpha/f$ (f=frequency) has a maximum value at a frequency $f_{max}$, where $f_{max} \cong 0.28(R/L)$ such that within a predetermined transition frequency range, current flow switches froms said at least one conductor to said resistive layer;

a dielectric layer surrounding said resistive layer;

a ground potential element adjacent said dielectric layer, said dielectric layer defining a capacitance between said resistive layer and said ground potential element; and said resistive layer formed of a predetermined material and dimensioned to exhibit said longitudinal resistance characteristic matched to the inductance characteristics of said magnetic composite layer and the capacitance defined by said dielectric layer, said resistance layer exhibiting an inductance substantially smaller than that of said at least one conductor as effected by said magnetic composite layer.

13. A transmission line according to claim 12, comprising:

said magnetic composite layer being lossy; and $f_{max} < 200$ MHz.

14. A transmission line according to claims 12 or 13, comprising:

said resistive layer surrounding said magnetic composite layer at predetermined discrete locations.

15. A transmission line according to claim 14, wherein said resistive layer is provided at a termination end of the transmission line.

16. A transmission line according to claims 12 or 13, comprising:

said resistive layer capacitively coupled to said at least one conductor at predetermined discrete locations.

17. A transmission line according to claim 16, wherein said resistive layer is capacitively coupled to said at least one conductor at a termination end of said transmission line.

18. A transmission line according to claim 16, wherein said resistive layer is capacitively coupled to said at least one conductor at predetermined intervals along said transmission line.

19. A transmission line according to claims 12 or 13, comprising:

said magnetic composite layer, said resistive layer, said dielectric layer and said ground potential element arranged concentrically with respect to said at least one conductor.

20. A transmission line according to claims 12 or 13, comprising:

said resistive layer having a frequency dependent resistance characteristic exhibiting increasing skin effect with increasing frequency.

21. A transmission line according to claims 12 or 13, comprising:

said resistive layer being only anisotropic.

22. A transmission line according to claims 12 or 13, comprising:

said at least one conductor concentrically surrounded by said magnetic composite layer;

said resistive layer concentrically surrounding said magnetic composite layer;

said dielectric layer concentrically surrounding said resistive layer; and said ground potential element comprising a first conductive layer concentrically surrounding said dielectric layer.

23. A transmission line according to claims 12 or 13, comprising:

plural of said electrical conductors, each concentrically surrounded by a respective magnetic composite layer which in turn is concentrically surrounded by a respective resistive layer;

said dielectric layer surrounding each resistive layer; and said ground potential element comprising a conductive layer concentrically surrounding said dielectric layer.

24. A transmission line according to claims 12 or 13, comprising:

plural of said electrical conductors commonly embedded in a common composite magnetic layer;

said resistive layer concentrically surrounding said common magnetic composite layer;

said dielectric layer concentrically surrounding said resistive layer; and said ground potential element comprising a conductive layer concentrically surrounding said dielectric layer.

25. A transmission line according to claims 12 or 13, comprising:

plural of said electrical conductors, each concentrically surrounded by a respective magnetic composite layer which in turn is concentrically surrounded by a respective resistive layer;

each resistive layer contiguous to each other and embedded in a common dielectric layer; and said ground potential elements comprising at least two conductors connected to ground.

26. A transmission line according to claim 25, comprising:

said at least two ground connected conductors disposed on opposite sides of a point of contiguity of said resistive layers.

27. A transmission line according to claim 25, comprising:

said at least two ground connectors and said resistive layers disposed in a line with said ground conductors at opposite sides of said resistive layers.

28. A transmission line according to claims 12 or 13, comprising:

said ground potential element, said dielectric layer, said resistive layer, said magnetic composite layer and said conductor each being planar and sequentially layered to define a flat-line implementation.

29. A transmisison line according to claim 22, further comprising:

a second magnetic composite layer, which is absorptive, surrounding said first conductive layer; and a second conductive layer connected to ground potential surrounding said second magnetic composite layer.

30. A transmission line according to claim 22, further comprising:

said first magnetic composite layer having inner and outer surfaces made conductive by the addition of selected materials thereto.

31. A transmission line according to claim 22, further comprising:

said first magnetic composite layer made more conductive by the addition of selected materials thereto.

32. A transmission line according to claim 30, further comprising:

said selected materials selected from the group consisting of magnetite and black carbon and added to said inner and outer surfaces to form respective conductive layers 0.5 mm thick.

33. A transmission line according to claim 31, further comprising:

said first composite magnetic layer formed of fine grain conductive manganese-zinc ferrite particles having magnetite or carbon black powder added thereto.

34. A transmisison line according to claim 22, further comprising:

a second magnetic composite layer, which is absorptive, surrounding said first conductive layer.

35. A transmission line according to claim 34, further comprising:

a further resistive layer surrounding said second magnetic composite layer.

36. A transmission line according to claim 22, wherein that first magnetic composite material includes metallic oxide content.

37. A transmission line according to claim 34, wherein the second magnetic composite material includes metallic oxide content.

38. A transmission line according to claim 34, wherein the first and second magnetic composite layers include metallic oxide content.

39. A transmission line according to claims 12 or 13, further comprising:

an artificial skin effect layer adjacent said magnetic composite layer for increasing the inductance of said magnetic composite layer and conductor combination.

40. A cable for the transmission of electrical energy and signals, comprising:

at least one electrical conductor exhibiting high frequency skin effect;

a low conductivity magnetic composite layer surrounding said at least one conductor and in combination therewith exhibiting an inductance characteristic greater than that of the conductor alone;

a resistive layer coupled to said magnetic composite layer and exhibiting a longitudinal resistance characteristic (R) matched at least to the inductance characterisitc (L) of said magnetic composite layer combined with the conductor to obtain a correspondingly determined low pass frequency characteristic $\alpha$(attenuation per meter of cable), wherein $\alpha/f$ (f=frequency) has a maximum value at a frequency $f_{max}$, where $$f_{max} \approx 0.28\ (R/L);$$

said cable having increased inductive effects in between the resistive layer and the conductor, but mainly resistive effect with decreased inductive effect outside the resistive layer; and an artificial skin effect layer adjacent said magnetic composite layer for increasing the inductance of said magnetic composite layer and conductor combination.

41. A cable according to claim 40, comprising: said magnetic composite layer being lossy; and $f_{max} < 200$ MHz.

* * * * *